US006506015B2

(12) United States Patent
Nagata et al.

(10) Patent No.: US 6,506,015 B2
(45) Date of Patent: Jan. 14, 2003

(54) CENTRIFUGAL COMPRESSOR AND CENTRIFUGAL TURBINE

(75) Inventors: Hiroki Nagata, Saitama (JP); Yu Narita, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/866,477

(22) Filed: May 29, 2001

(65) Prior Publication Data

US 2002/0021962 A1 Feb. 21, 2002

(30) Foreign Application Priority Data

May 29, 2000 (JP) ..... 2000-163159

(51) Int. Cl.[7] ..... F01D 11/08
(52) U.S. Cl. ..... 415/173.1; 415/206
(58) Field of Search ..... 415/203, 206, 415/204, 173.1

(56) References Cited

U.S. PATENT DOCUMENTS 2,827,261 A * 3/1958 Parker et al. ..... 415/143
3,966,351 A * 6/1976 Sproule ..... 415/110
4,212,585 A * 7/1980 Swarden et al. ..... 415/198.1
4,354,802 A * 10/1982 Nishida et al. ..... 415/207
4,460,313 A * 7/1984 Austrem ..... 415/178
5,145,317 A * 9/1992 Brasz ..... 415/224.5

* cited by examiner

*Primary Examiner*—Edward K. Look
*Assistant Examiner*—Ninh Nguyen
(74) *Attorney, Agent, or Firm*—Arent Fox Kintner Plotkin & Kahn, PLLC

(57) ABSTRACT

A centrifugal compressor for a turbo-fan engine includes a shroud covering the edges of vanes of a compressor wheel mounted on an outer shaft with a clearance α left therebetween. A vertical section of the shroud includes an upstream portion extending in an axial direction, and a downstream portion curved radially outwards and extending from a downstream end of the upstream portion. The thickness of the downstream portion is increased gradually from the upstream side toward the downstream side. Thus, it is possible to prevent the variation of the clearance α defined along the downstream portion of the shroud which exerts a large influence on the compression performance, thereby suppressing the reduction in performance due to the thermal expansion of the shroud.

4 Claims, 7 Drawing Sheets

CENTRIFUGAL COMPRESSOR AND CENTRIFUGAL TURBINE

BACKGROUND OF THE INVENTION

1. Field of the Invention

The present invention relates to a centrifugal compressor including a shroud covering the edges of the vanes of a compressor wheel mounted on a rotary shaft with a predetermined clearance left therebetween, and also relates to a centrifugal turbine including a shroud covering the edges of the vanes of a turbine wheel mounted on a rotary shaft with a predetermined clearance left therebetween.

2. Description of the Related Art

In a centrifugal compressor adapted to compress air axially drawn by the compressor wheel mounted on a rotary shaft and to discharge the compressed air radially outwards, an enhancement in compression performance can be provided by keeping the clearance defined between the edges of the vanes of the compressor wheel and an inner surface of the shroud to a small size. However, there is a limit to decreasing the clearance due to the limitation of processing accuracy and the thermal expansion of the shroud, caused by the heat of compression of the air. Therefore, a centrifugal compressor has been proposed in Japanese Patent Application Laid-open No. 5-196598, in which a step is formed on an inner wall surface of a shroud opposed to the downstream end of a compressor wheel to decrease the sectional area of a flow path, so that the air leaking into the clearance, is dammed up by the step to prevent a reduction in compression efficiency.

However, the above prior art centrifugal compressor suffers from a problem that the air leaks through spaces between the vanes of the compressor wheel into the clearance and for this reason, the vanes cannot provide a sufficient centrifugal force to the leaked air and as a result, a reduction in compression efficiency is unavoidable. The problem that the clearance between the edges of the vanes and the inner surface of the shroud is varied due to the thermal expansion, as described above, also arises in a centrifugal turbine.

SUMMARY OF THE INVENTION

The present invention has been developed with the above circumstances in view, and it is an object of the present invention to suppress the variation in clearance defined between the edges of the vanes of the compressor wheel or the turbine wheel and the inner surface of the shroud to prevent a reduction in performance.

To achieve the above object, according to a first aspect and feature of the present invention, there is provided a centrifugal compressor including a shroud covering edges of vanes of a compressor wheel mounted on a rotary shaft with a predetermined clearance therebetween. A vertical section of the shroud includes an upstream portion extending in an axial direction of the rotary shaft, and a downstream portion curved radially outwards of the rotary shaft and extending from the downstream end of the upstream portion. The thickness of the downstream portion is increased from the upstream side toward the downstream side.

With the above arrangement, the thickness of the downstream portion curved radially outwards and extending from the upstream portion of the shroud is increased from the upstream side toward the downstream side. Therefore, the rigidity of the downstream portion can be increased to suppress the axial displacement due to the thermal expansion. Thus, it is possible to prevent the variation in the clearance defined between the compressor wheel and the downstream portion of the shroud which exerts a large influence in the compression performance of the centrifugal compressor, and to suppress the thermal expansion of the shroud thereby minimizing the reduction in performance.

According to a second aspect and feature of the present invention, there is provided a centrifugal turbine including a shroud covering the edges of the vanes of a turbine wheel mounted on a rotary shaft, with a predetermined clearance left therebetween, a vertical section of the shroud including a downstream portion extending in an axial direction of the rotary shaft, and an upstream portion curved radially outwards of the rotary shaft and extending from an upstream end of the downstream portion. The thickness of the upstream portion is increased from the downstream side toward the upstream side.

With the above arrangement, the thickness of the upstream portion curved radially outwards and extending from the downstream portion of the shroud, is increased from the downstream side toward the upstream side. Therefore, the rigidity of the upstream portion can be increased to suppress the axial displacement due to thermal expansion. Thus, it is possible to prevent the variation of the clearance defined between the turbine wheel and the upstream portion of the shroud which exerts a large influence on the power performance of the centrifugal turbine, and to suppress the thermal expansion of the shroud, thereby minimizing the reduction in performance.

The above and other objects, features and advantages of the invention will become apparent from the following description of the preferred embodiments taken in conjunction with the accompanying drawings.

BRIEF DESCRIPTION OF THE DRAWINGS

FIGS. 1 to 5 show a first embodiment of the present invention, wherein

FIG. 1 is a vertical sectional view of a turbo-fan engine;

FIG. 2 is an enlarged view of a portion indicated by Numeral 2 in FIG. 1;

FIG. 3 is a vertical sectional view of a shroud;

FIG. 4 is a graph showing the relationship between the thickness ratio between an upstream portion and a downstream portion of the shroud and the displacement of an intermediate portion of the shroud;

FIG. 5 is a graph showing the relationship between the thickness ratio between the upstream portion and the downstream portion of the shroud and the displacement of a radially outer end of the shroud;

DESCRIPTION OF THE PREFERRED EMBODIMENTS

A first embodiment of the present invention will now be described with reference to FIGS. 1 to 5.

Figure 1:
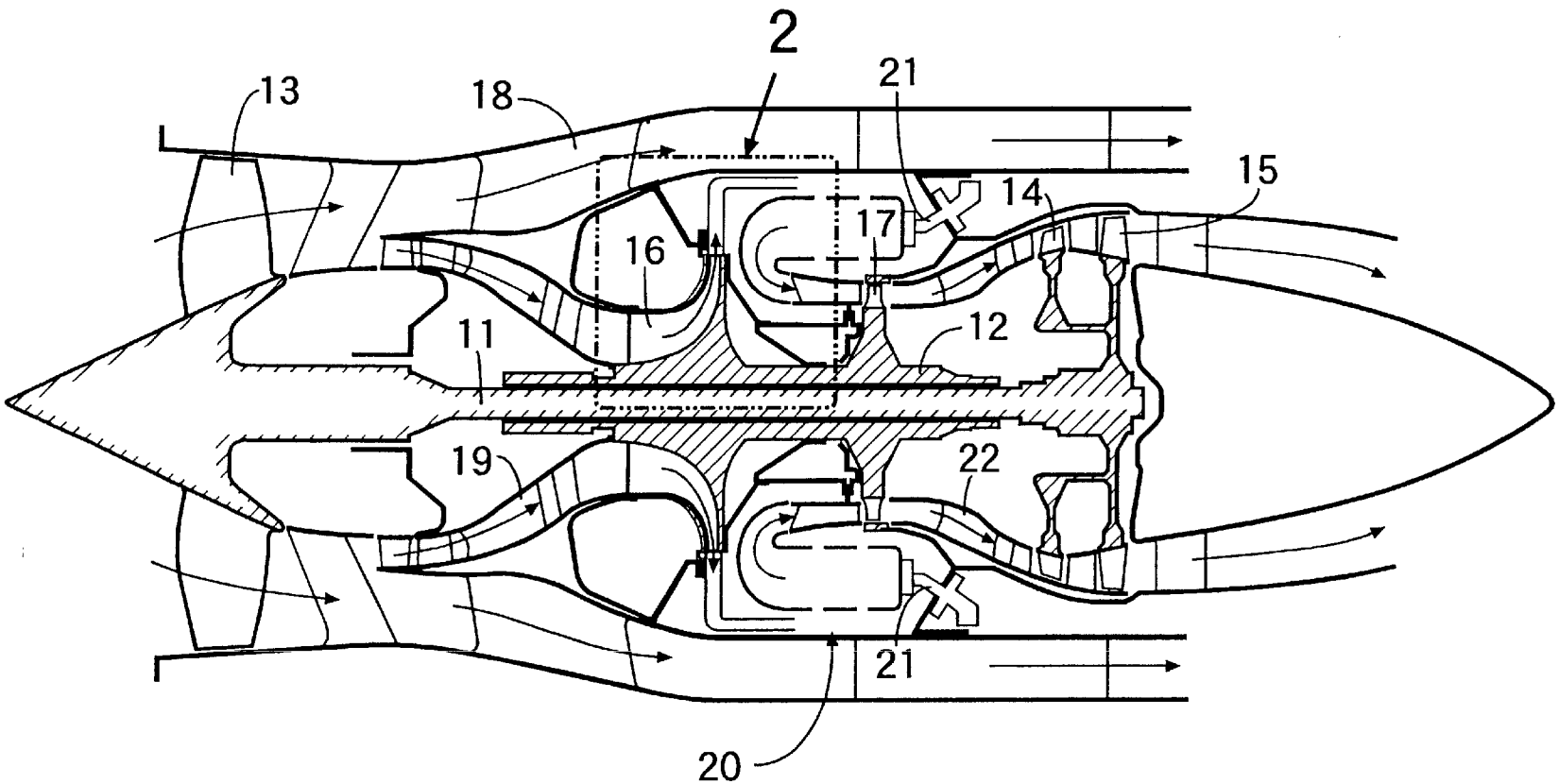

First, the entire structure of a turbo-fan engine will be described with reference to FIG. 1. The turbo-fan engine includes an inner shaft 11, and an outer shaft 12 as a rotary shaft relatively rotatably fitted over an outer periphery of the inner shaft 11. An axial-flow fan 13 is mounted at the front end of the inner shaft 11, and a first-stage low-pressure turbine wheel 14 and a second-stage turbine wheel 15 are mounted at the rear end of the inner shaft 11. A centrifugal compressor wheel 16 is mounted at the front end of the outer shaft 12 which is shorter than the inner shaft 11, and an axial-flow high-pressure turbine wheel 17 is mounted at the rear end of the outer shaft 12.

A portion of the air drawn through a front portion of the engine and compressed by the fan 13, is passed through a bypass passage 18 disposed along an outer periphery of the engine and discharged from a rear portion of the engine. The remainder of the air is directed via a compressed-air passage 19 disposed radially inside the bypass passage 18 to the compressor wheel 16. The air further compressed by the compressor wheel 16, is supplied to an annular burner 20, where it is mixed with fuel supplied thereto from fuel injection nozzles 21, and the resulting mixture is burnt. A combustion gas generated in the burner 20 is passed via the high-pressure turbine wheel 17 mounted at an upstream end of a combustion gas passage 22 and the first-stage and second-stage low-pressure turbine wheels 14 and 15 mounted at an intermediate portion of the combustion gas passage 22, and is discharged from the rear portion of the engine.

Figure 2:
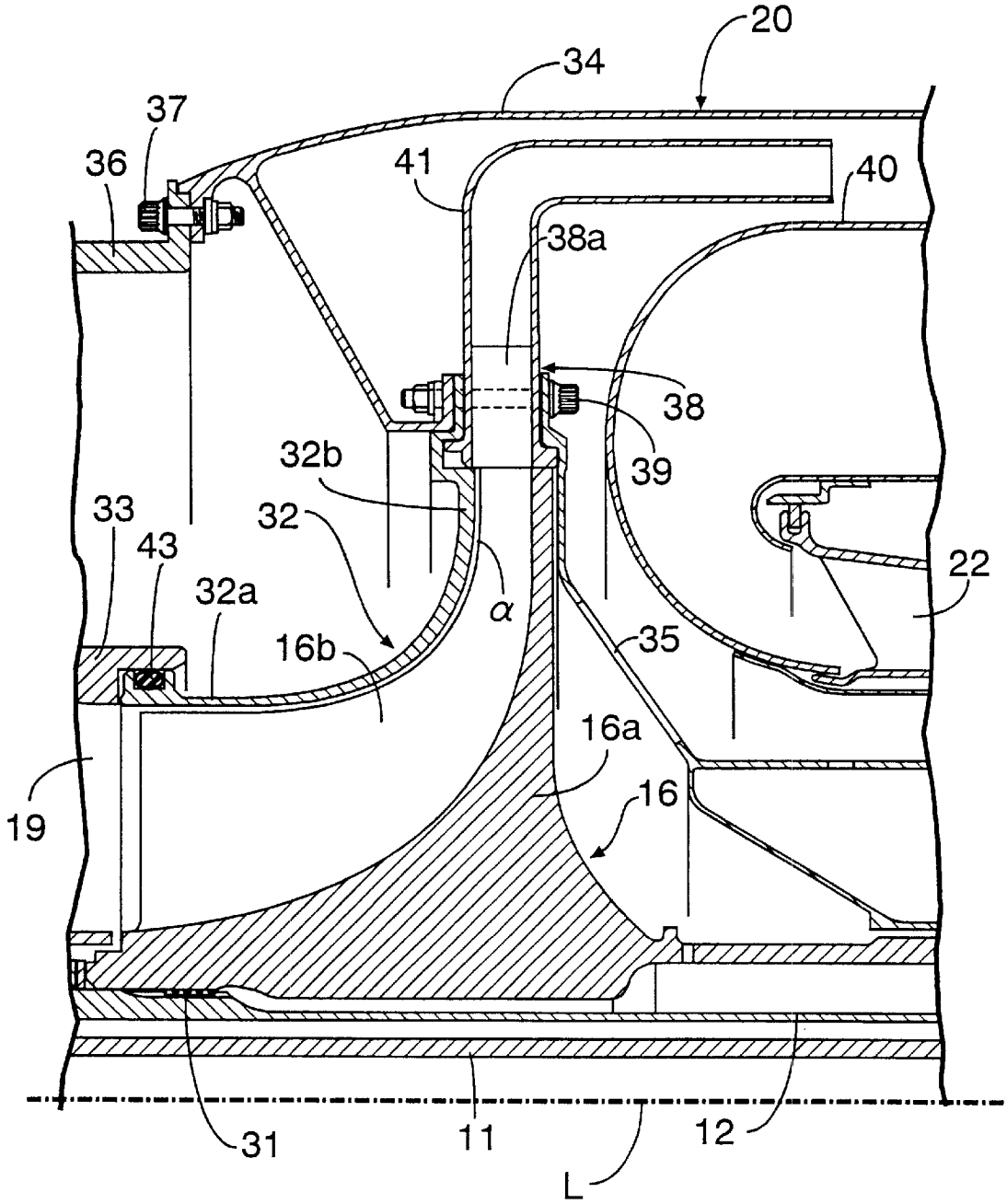

As can be seen from FIG. 2, the compressor wheel 16 is spline-coupled at 31 to an outer periphery of a front portion of the outer shaft 12 rotated about an axis L, and includes a solid disk 16*a*, and a large number of vanes 16*b* formed radially on a front surface of the disk 16*a*. A shroud 32 is opposed to the edges of the vanes 16*b* of the compressor wheel 16 with a slight clearance $\alpha$ left therebetween, and the vanes 16*b* are disposed in a space defined between an inner surface of the shroud 32 and the front surface of the disk 16*a*. Upstream ends of the vanes 16*b* face the compressed-air passage 19 defined by a casing 33, and downstream ends of the vanes 16*b* face connections of a casing 34 forming an outer wall of the burner 20 and a casing 35 forming an inner wall of the burner 20. The casing 34 forming the outer wall of the burner 20, is coupled to a casing 36 forming an inner wall of the bypass passage 18 by bolts 37.

Figure 3:
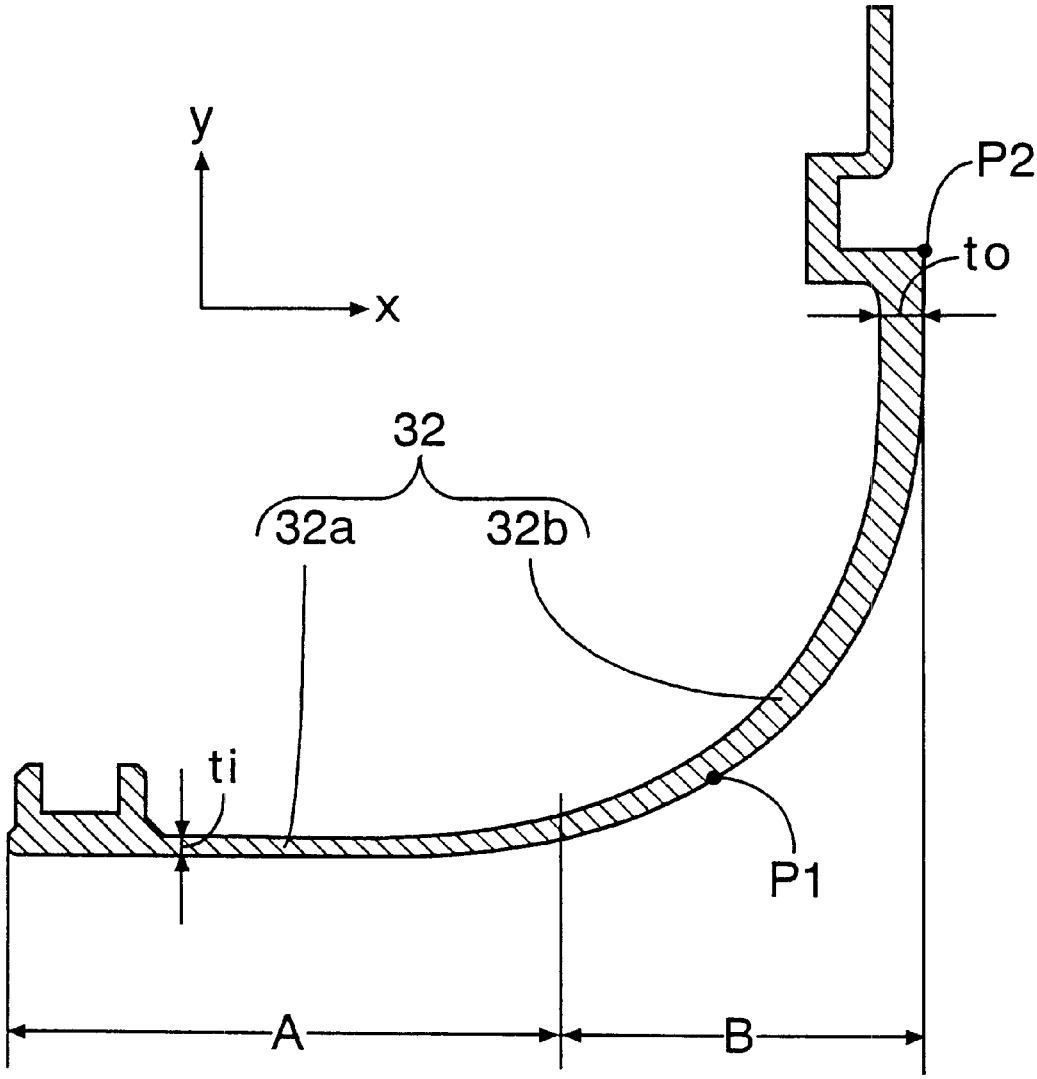

As can be seen from FIG. 3, the shroud 32 includes an upstream portion 32*a* extending in a direction of the axis L, and a downstream portion 32*b* curved radially outwards and extending from the downstream end of the upstream portion 32*a*. The ratio of an axial length A of the upstream portion 32*a* to an axial length B of the downstream portion 32*b* is set at about 3:2. The upstream portion 32*a* has a uniform thickness ti (e.g., of 1.2 mm), and the thickness of the downstream portion 32*b* is equal at its upstream end to that of the upstream portion 32*a* and is increased gradually from the upstream side toward the downstream side. The thickness to of the downstream end of the downstream portion 32*b* is about 1.5 times (e.g., 1.8 mm) the thickness ti of the upstream portion 32*a*.

Referring again to FIG. 2, a diffuser 38 including a large number of diffuser vanes 38*a* to convert the kinetic energy of the air compressed by the compressor wheel 16 into a pressure energy, is fastened between connections of the casings 34 and 35 forming the outer and inner walls of the burner 20 by bolts 39. At this point, the downstream portion 32*b* of the shroud 32 is commonly fastened between the diffuser 38 and the casing 34. The diffuser 38 extends into the burner 20 having a plurality of flame tubes 40 accommodated therein, and a manifold 41 is integrally formed at a downstream portion of the diffuser 38. An outer peripheral surface of the upstream portion 32*a* of the shroud 32 is in abutment against an inner peripheral surface of the casing 33 defining the compressed-air passage 19 with a seal member 43 interposed therebetween.

When the fan 13 compresses the air with the operation of the engine, the temperature of the upstream end of the upstream portion 32*a* of the shroud 32 is raised to about 100° C., and the temperature of the downstream end of the downstream portion 32*b* is raised up to about 400° C., by the compression heat of the air. Therefore, various portions of the shroud 32 made of a stainless steel, are deformed by thermal expansion.

Figure 4:
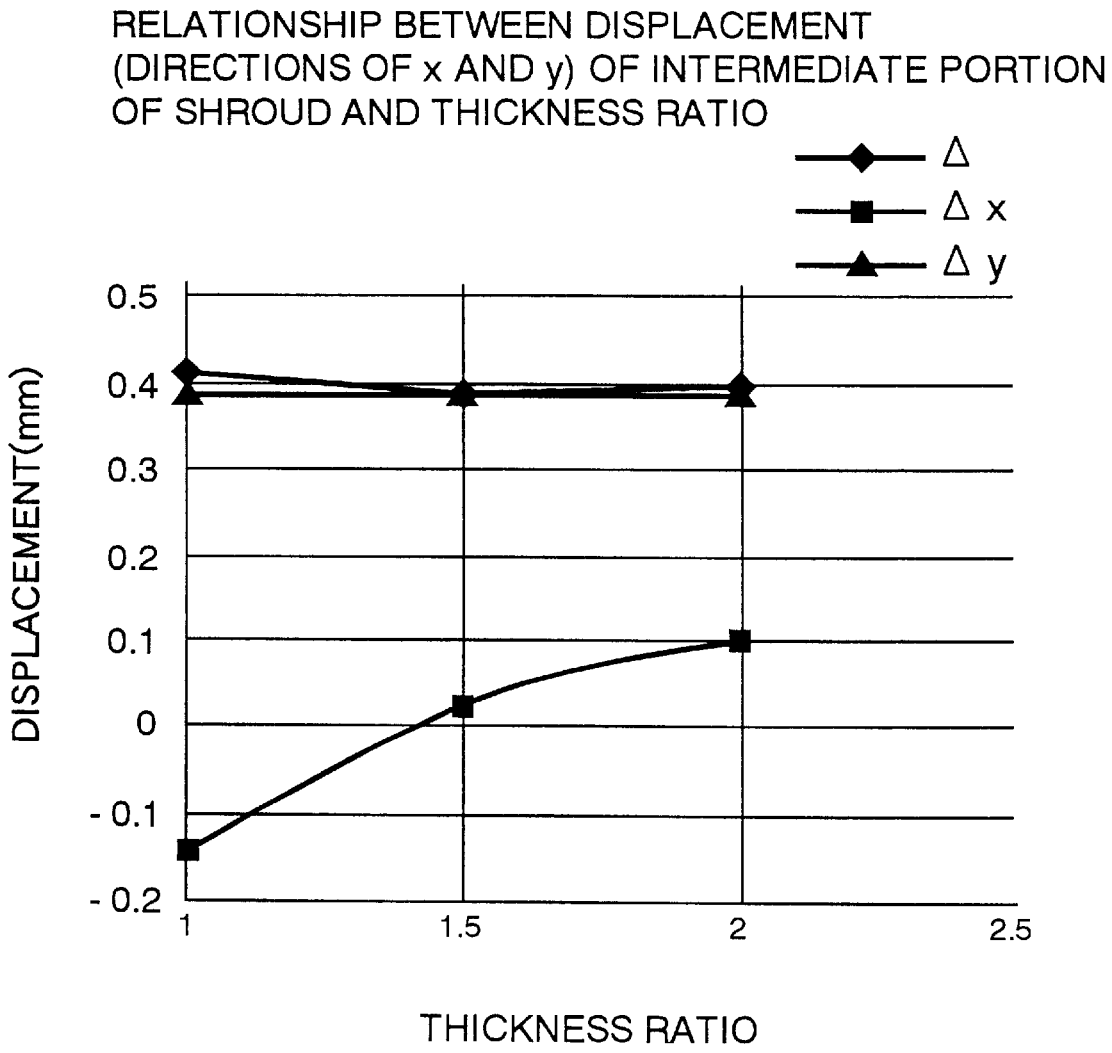

A graph in FIG. 4 shows the displacement of a central portion P1 (see FIG. 3) of the shroud 32, when the ratio to/ti of the thickness ti of the upstream portion 32*a* of the shroud 32 to the thickness to of the downstream end of the downstream portion 32*b* has been varied. Here, a displacement $\Delta x$ indicates a displacement in a direction of an x-axis (the rearward of the engine is positive); a displacement $\Delta y$ indicates a displacement in a direction of a y-axis (the radially outer side of the engine is positive); a composite displacement $\Delta$ indicates a displacement resulting from the combination of the displacement $\Delta x$ and the displacement $\Delta y$.

As apparent from the graph, the displacement $\Delta y$ of the central portion P1 of the shroud 32 and the composite displacement $\Delta$ are small and maintained at about 0.4 mm, even if the thickness ratio to/ti is changed from 1 to 2. In contrast, the displacement $\Delta x$ of the central portion P1 of the shroud 32 is varied to a large extent in accordance with the thickness ratio to/ti. More specifically, in a range of the thickness ratio to/ti from 1 to about 1.4, the displacement $\Delta x$ assumes a negative value and is increased from −1.4 mm to 0 mm, and in a range of the thickness ratio to/ti from about 1.4 to 2, the displacement $\Delta x$ assumes a positive value and is increased from 0 mm to about 0.1 mm. Therefore, the central portion P1 of the shroud 32 is not displaced in the direction of the x-axis, when the thickness ratio to/ti is about 1.4.

Figure 5:
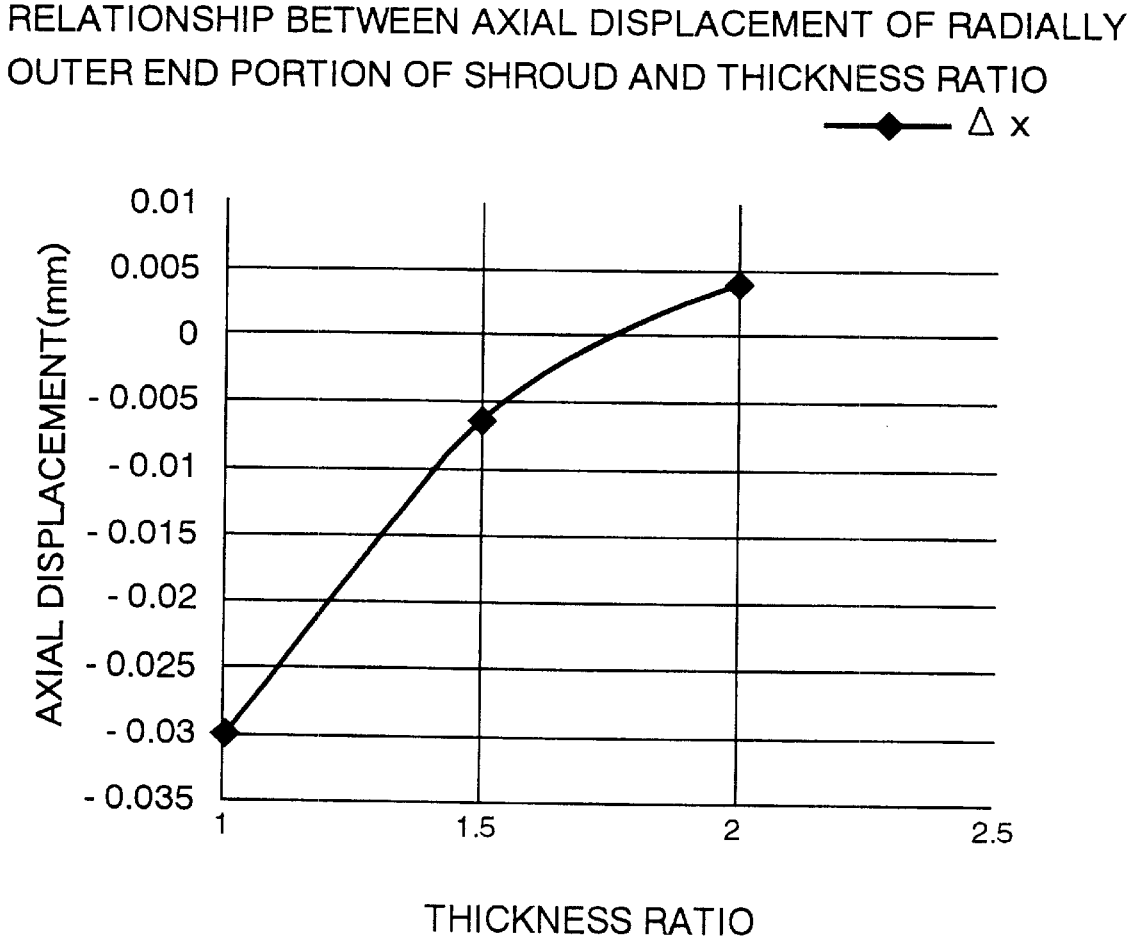

A graph in FIG. 5 shows the displacement of a radially outer end P2 (see FIG. 3) of the shroud 32 in a direction of an x-axis, when the ratio to/ti of the thickness ti of the upstream portion 32*a* of the shroud 32 to the thickness to of the downstream end of the downstream portion 32*b* has been varied. As apparent from the graph, the displacement $\Delta x$ of the radially outer end of the shroud 32 assumes a negative value and is increased from about −0.03 mm to 0 mm in a range of the thickness ratio to/ti from 1 to about 1.75, and assumes a positive value and is increased from 0 mm to about 0.004 mm in a range of the thickness ratio to/ti from about 1.75 to 2. Therefore, the radially outer end P2 of the shroud 32 is not displaced in the direction of the x-axis, when the thickness ratio to/ti is about 1.75.

It is considered that the above-described thermal expansion characteristic of the shroud 32 is attributable mainly to an increase in rigidity attendant on an increase in thickness to of the downstream portion 32*b* of the shroud 32.

Figure 7:
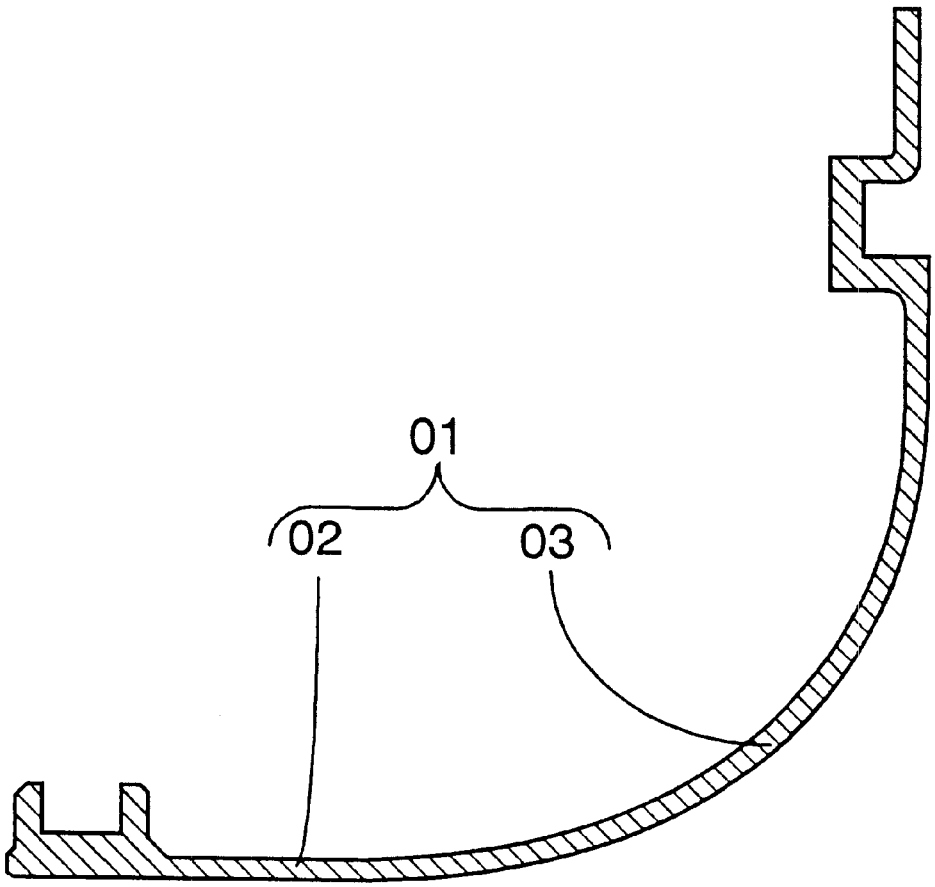
FIG. 7 is a vertical sectional view of a conventional shroud.

A case where the thickness ratio to/ti is 1 in the graphs in FIGS. 4 and 5 corresponds to a case where the thickness is uniform over the entire area of an upstream portion 02 and a downstream portion 03 of the conventional shroud 01 shown in FIG. 7.

From the forgoing, if the ratio to/ti of the thickness to of the downstream end of the downstream portion 32*b* and the thickness ti of the upstream portion 32*a* of the shroud 32 is set at a value near 1.5, the displacement $\Delta x$ of the shroud 32 in a region from the intermediate portion P1 to the radially outer end P2 of the shroud 32 (roughly the downstream portion 32*b* of the shroud 32) in the direction of the x-axis can be suppressed to the minimum to prevent a reduction in efficiency of compression of the air by the compressor wheel 16.

What greatly governs the performance of the compressor wheel 16 is the clearance a at the downstream portion 32*b* of the shroud 32 where the pressure of the compressed air is highest. In the downstream portion 32*b,* the inner surface of the shroud 32 and the edges of the vanes 16*b* of the compressor wheel 16 are confronted with each other in a longitudinal direction of the x-axis and hence, the displacement Δx of the downstream portion 32*b* of the shroud 32 in the direction of the x-axis directly governs the size of the clearance α. Even if the inner surface of the downstream portion 32*b* of the shroud 32 is displaced in the direction of the y-axis relative to the edges of the vanes 16*b* of the compressor wheel 16, the clearance α at the downstream portion 32*b* is varied only slightly. Therefore, if the displacement Δx of the downstream portion 32*b* of the shroud 32 is decreased, the variation in the clearance α at the downstream portion 32*b* can be decreased to suppress the reduction in performance of the compressor wheel 16 due to the thermal expansion of the shroud 32.

Figure 6:
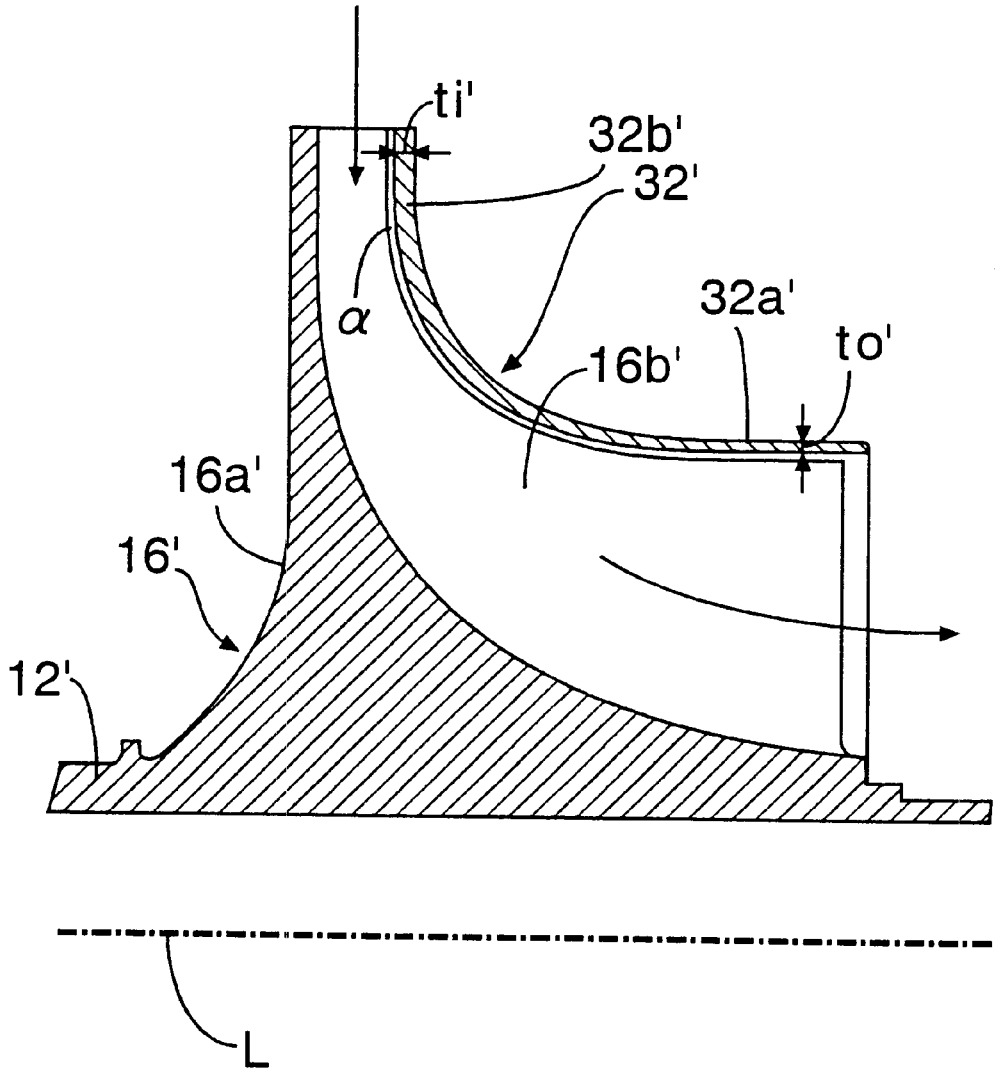
FIG. 6 is a vertical sectional view of a turbine wheel and a shroud according to a second embodiment of the present invention.

A second embodiment of the present invention will now be described with reference to FIG. 6.

In the second embodiment, the present invention is applied to a shroud 32' covering a turbine wheel 16' supported on a rotary shaft 12'. The turbine wheel 16' is comprised of a turbine disk 16*a'* and vanes 16*b'*. The shroud 32' opposed to edges of the vanes 16*b'* with a clearance a left therebetween includes a downstream portion 32*a'* extending in a direction of an axis L of the rotary shaft 12', and an upstream portion 32*b'* curved radially outwards and extending from an upstream end of the downstream portion 32*a'*. The downstream portion 32*a'* of the shroud 32' has a uniform thickness to'. The thickness of the upstream portion 32*b'* is equal at its downstream end to that of the downstream portion 32*a'* and is increased gradually from the downstream end toward an upstream end. The thickness ti' of the upstream end of the upstream portion 32*b'* is about 1.5 times the thickness to' of the downstream portion 32*a'*.

When a combustion gas passes through the turbine wheel 16' with the operation of a gas turbine engine, the shroud 32' covering the turbine wheel 16' is thermally expanded by the heat of the combustion gas. At this time, the axial displacement of the upstream portion 32*b'* of the shroud 32' having a larger thickness, is suppressed by an effect similar to that for the shroud 32 covering the compressor wheel 16 described above in the first embodiment. Therefore, it is possible to prevent the variation in the clearance α at the upstream portion 32*b'* of the shroud 32, to prevent a reduction in the power performance of the turbine wheel 16'.

Although the thickness ti of the upstream portion 32*a* of the shroud 32 is uniform, and the thickness to of the downstream portion 32*b* is increased gradually from the upstream side toward the downstream side in the first embodiment, the thickness may be increased gradually over the entire area of the upstream portion 32*a* and the downstream portion 32*b,* or the thickness may be increased with some steps. Likewise, although the thickness to' of the downstream portion 32*a'* of the shroud 32' is uniform, and the thickness ti' of the upstream portion 32*b'* is increased gradually from the downstream end toward the upstream end in the second embodiment, the thickness may be increased gradually over the entire area of the downstream portion 32*a'* and the upstream portion 32*b',* or the thickness may be increased with some steps.

In addition, although the maximum value of the thickness to of the downstream portion 32*b* of the shroud 32 is set at 1.5 times the thickness ti of the upstream portion 32*a* in the first embodiment, such magnification is not limited to 1.5. Likewise, although the maximum value of the thickness ti of the upstream portion 32*b'* of the shroud 32' is set at 1.5 times the thickness to' of the downstream portion 32*a'* in the second embodiment, such magnification is not limited to 1.5.

Further, in the centrifugal compressor and the centrifugal turbine according to the embodiments, the direction of flowing-in of the fluid and the direction of flowing-out of the fluid are at 90°, but the present invention is also applicable to a centrifugal compressor or a centrifugal turbine of an obliquely flowing type in which a direction of flowing-in of a fluid and a direction of flowing-out of a fluid form an obtuse angle.

Although the embodiments of the present invention have been described in detail, it will be understood that the present invention is not limited to the above-described embodiments, and various modifications in design may be made without departing from the spirit and scope of the invention defined in claims.

What is claimed is:

1. A centrifugal compressor comprising a rotary shaft, a compressor wheel mounted on the rotary shaft, the compressor wheel having vanes extending therefrom, and a shroud covering the edges of the vanes with a predetermined clearance between the edges of the vanes and the shroud, a vertical section of the shroud including an upstream portion extending in an axial direction of the rotary shaft, and a downstream portion curved radially outwards of the rotary shaft and extending from a downstream end of the upstream portion, wherein the thickness of the downstream portion increases from the upstream side toward the downstream side, wherein the ratio of the thickness at the downstream end of the downstream portion of the shroud to the thickness at the upstream end of the upstream portion of the shroud is about 1.5.

2. A centrifugal compressor as set forth in claim 1, wherein the ratio of the axial length of the upstream portion of the shroud to the axial length of the downstream portion of the shroud is 3:2.

3. A centrifugal turbine comprising a rotary shaft, a turbine wheel mounted on the rotary shaft, the turbine wheel having vanes extending therefrom, and a shroud covering the edges of the vanes with a predetermined clearance between the edges of the vanes and the shroud, a vertical section of the shroud including a downstream portion extending in an axial direction of the rotary shaft, and an upstream portion curved radially outwards of the rotary shaft and extending from an upstream end of the downstream portion, wherein the thickness of the upstream portion increases from the downstream side toward the upstream side, wherein the ratio of the thickness at the upstream end of the upstream portion of the shroud to the thickness at the downstream end of the downstream portion of the shroud is about 1.5.

4. A centrifugal turbine comprising a rotary shaft, a turbine wheel mounted on the rotary shaft, the turbine wheel having vanes extending therefrom, and a shroud covering the edges of the vanes with a predetermined clearance between the edges of the vanes and the shroud, a vertical section of the shroud including a downstream portion extending in an axial direction of the rotary shaft, and an upstream portion curved radially outwards of the rotary shaft and extending from an upstream end of the downstream portion, wherein the thickness of the upstream portion increases from the downstream side toward the upstream side, wherein the ratio of the axial length of the downstream portion of the shroud to the axial length of the upstream portion of the shroud is 3:2.

* * * * *